US011148911B2

(12) United States Patent
Vencl

(10) Patent No.: US 11,148,911 B2
(45) Date of Patent: Oct. 19, 2021

(54) POSITIVE LOCKING LATCH ASSEMBLY FOR HOOK

(71) Applicant: The Crosby Group LLC, Tulsa, OK (US)

(72) Inventor: Chase Vencl, Bixby, OK (US)

(73) Assignee: The Crosby Group LLC, Tulsa, OK (US)

( * ) Notice: Subject to any disclaimer, the term of this patent is extended or adjusted under 35 U.S.C. 154(b) by 0 days.

(21) Appl. No.: 16/783,518

(22) Filed: Feb. 6, 2020

(65) Prior Publication Data

US 2020/0255264 A1 Aug. 13, 2020

Related U.S. Application Data

(60) Provisional application No. 62/802,273, filed on Feb. 7, 2019.

(51) Int. Cl.
*B66C 1/36* (2006.01)

(52) U.S. Cl.
CPC ..... *B66C 1/36* (2013.01)

(58) Field of Classification Search
CPC ..... B66C 1/36; F16B 45/02
USPC ..... 294/82.2, 82.21
See application file for complete search history.

(56) References Cited

U.S. PATENT DOCUMENTS 1,411,549 A * 4/1922 Abbott ..... B66C 1/36 294/82.21
1,508,705 A * 9/1924 Mahan ..... F16B 45/02 294/82.21
1,914,189 A * 6/1933 Yingling ..... B66C 1/36 294/82.2
1,985,596 A * 12/1934 Burnham ..... F16B 45/02 294/82.2
2,514,656 A * 7/1950 Manson ..... F16B 45/02 24/599.5
3,575,458 A 4/1971 Crook, Jr. et al.
3,741,600 A 6/1973 Crook, Jr.
RE28,709 E 2/1976 Crook, Jr.
4,440,432 A * 4/1984 Goris ..... B66C 1/36 24/599.8
4,948,190 A * 8/1990 Lucas ..... B66C 1/36 24/599.5
4,977,647 A * 12/1990 Casebolt ..... B66C 1/36 24/599.5
5,020,843 A * 6/1991 Lucas ..... B66C 1/36 24/599.5

* cited by examiner

*Primary Examiner* — Dean J Kramer

(74) *Attorney, Agent, or Firm* — Head, Johnson, Kachigian & Wilkinson, PC

(57) ABSTRACT

A positive locking latch assembly for a hook having an open saddle. The latch assembly includes a latch body having a latch face and a pair of opposed sides. The latch body rotates between an open position and a closed position. A torsion spring urges the latch body toward the closed position. A lock plate retained within the latch body is movable between a locked and an unlocked position. A compression spring urges the lock plate toward the locked position. A tab extending from the lock plate extends into an opening in the latch face. A lip extending from the tab is manually movable to engage the latch face in order to retain the lock plate in an unlocked position.

8 Claims, 8 Drawing Sheets

POSITIVE LOCKING LATCH ASSEMBLY FOR HOOK

CROSS-REFERENCE

This application is based on and claims priority to U.S. Provisional Patent Application Ser. No. 62/802,273, filed Feb. 7, 2019, which is incorporated herein in its entirety by reference.

BACKGROUND OF THE INVENTION

1. Field of the Invention

The present invention relates to a hook for lifting loads wherein the hook includes a positive locking latch assembly. In particular, the present invention relates to a positive locking latch assembly for a hook which will automatically move to both a locked and a closed position upon entry of a load into a hook.

2. Description of the Related Art

Various types of industrial hooks are utilized for lifting large loads. A hook assembly will typically have a hook with a body including a shank with an open saddle or mouth for receiving a load or rigging for the load. The hook, in turn, will be connected to rigging, such as a wire line, to raise the load. The hook may feature an eye, a clevis, a swivel, or other attachment mechanism. In some cases, the hook assembly includes a latch for closing the saddle or mouth of the hook so that the load or rigging cannot be dislodged or removed from the hook unless the latch is moved to an open position.

In some cases, the latch assembly is normally biased to a closed position. Applicant's prior U.S. Pat. No. 3,575,458 discloses an example of a hook with a safety gate latch. A lock member pivotally mounted on the latch is movable to a first locked position in order to prevent opening of the latch and movable into a second, open position to allow the latch to be pivoted to an open position.

Notwithstanding the foregoing, there remains a need to provide an automatic locking latch assembly for a hook which is manually movable from a locked position to an unlocked position.

There also remains a need to provide a positive locking latch assembly for a hook wherein the latch assembly will be automatically moved from a closed and unlocked position to a locked and closed position by force of a load inserted into a saddle of the hook.

SUMMARY OF THE INVENTION

The present invention is directed to a positive locking latch assembly for a hook.

The latch assembly includes a latch body having a latch face with a pair of opposed sides extending therefrom. When in a closed position, the latch face engages the hook so that the latch body is in the closed position.

A pivot shaft passes transversely through the latch body and through an opening in a shank of the hook to permit the latch body to rotate between an open position and a closed position.

A torsion spring surrounds the pivot shaft and urges the latch body toward the closed position. A lock plate is retained within the lock body. The lock plate is movable between a locked position and an unlocked position. A compression spring within the latch body extending between the lock plate and the latch face urges the lock plate toward the locked position.

A pair of opposed arcuate first slots are provided in the opposed sides of the latch body. The first slots each have an enlarged upper portion. A pair of first extending side posts extend from opposed sides of the lock plate. The pair of first side posts are movable within the pair of first slots so that the lock plate moves between a locked position and an unlocked position.

A tab extends outwardly from the lock plate and terminates in a lip extending from the tab. The lip of the tab extends into an opening in the latch face.

A pair of second slots are on opposed sides of the latch body. The lock plate has a pair of opposed second extending side posts that are received in the pair of second slots. The second side posts are movable within the second slots to retain the lock plate in an unlocked position.

The lock plate may be manually moved from a locked to an unlocked position by manually moving and rotating one or both of the first side posts in the arcuate pair of first slots. The manual movement of the lock plate overcomes the force of the compression spring. The pair of arcuate first slots is wider or enlarged at their upper end. Accordingly, the lock plate may also be slid or manually moved upward.

As the lock plate is moved upward, the second posts are moved upward in the second slots. Accordingly, the tab extends beyond the face of the latch body. As the lock plate is slowly released, the compression spring urges the lock plate and the tab toward the locked position and the lip will engage the latch face of the latch body. Accordingly, the latch body is retained in an unlocked position.

While the latch body is in the closed and unlocked position, a load or rigging for a load may be moved toward and into the mouth and into the saddle of the hook. The force of the incoming load will overcome the force of the torsion spring and move the latch body from the closed position toward the open position. In addition, the incoming load will engage the lip of the tab, forcing the lip and the tab downward. Accordingly, the lip and the tab will be disengaged from the outer face of the latch body. Once the lip has been disengaged from the latch face, the torsion springs urge the latch body toward the closed position.

When the load has moved past the latch body and moved into the saddle of the hook, the force of the compression spring will thereafter rotate the locking plate back to the locked position. Accordingly, the latch body will automatically return to the locked and closed position.

DETAILED DESCRIPTION OF THE INVENTION

Figure 1:
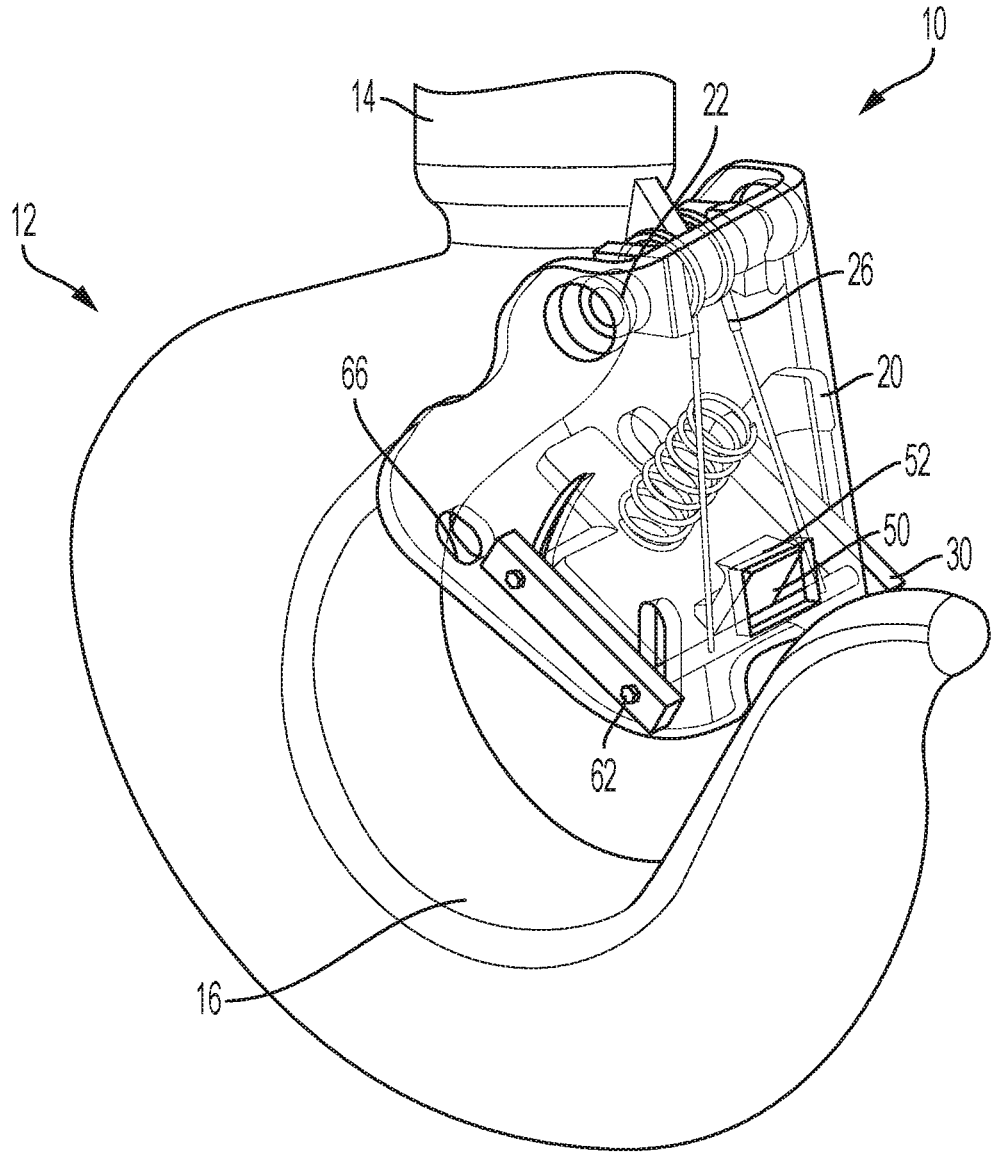
FIGS. 1 through 4 illustrate perspective views showing sequential, alternate positions of a positive locking latch assembly for a hook constructed in accordance with the present invention.

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Referring to the drawings in detail, FIGS. 1 through 4 illustrate perspective views of a positive locking latch assembly 10 installed on and in use with a hook 12.

FIGS. 1 through 4 illustrate perspective views of sequential, alternate positions of the latch assembly 10 and hook 12. FIGS. 5 through 8 illustrate side views of the latch assembly 10 and hook 12 in the same sequential positions as shown in FIGS. 1 through 4. The hook 12 itself will include a shank 14 (only partially visible in FIGS. 1 through 4). The shank 14 of the hook 12 may be connected to an eye, clevis, swivel, or other attachment mechanism (not shown). The attachment mechanism may, in turn, be connected to rigging, such as a wire line.

The hook 12 includes an upwardly extending tip and a saddle 16 having an open mouth for receipt of a load or rigging for a load (not shown).

The latch assembly 10 may be produced as a part of the hook 12 or, alternatively, the latch assembly 10 may be added on or retrofit to an existing hook 12. The latch assembly 10 may be fabricated from metal components or other sturdy material.

The latch assembly includes a latch body having a latch face 20. The latch body in the figures is shown in phantom so that the internal components are visible. The latch body is generally U-shaped with a pair of opposed sides extending from the latch face 20. When in a closed position, as shown in FIGS. 1 and 5, the latch face 20 engages the hook 12 so that the latch body closes.

Figure 3:
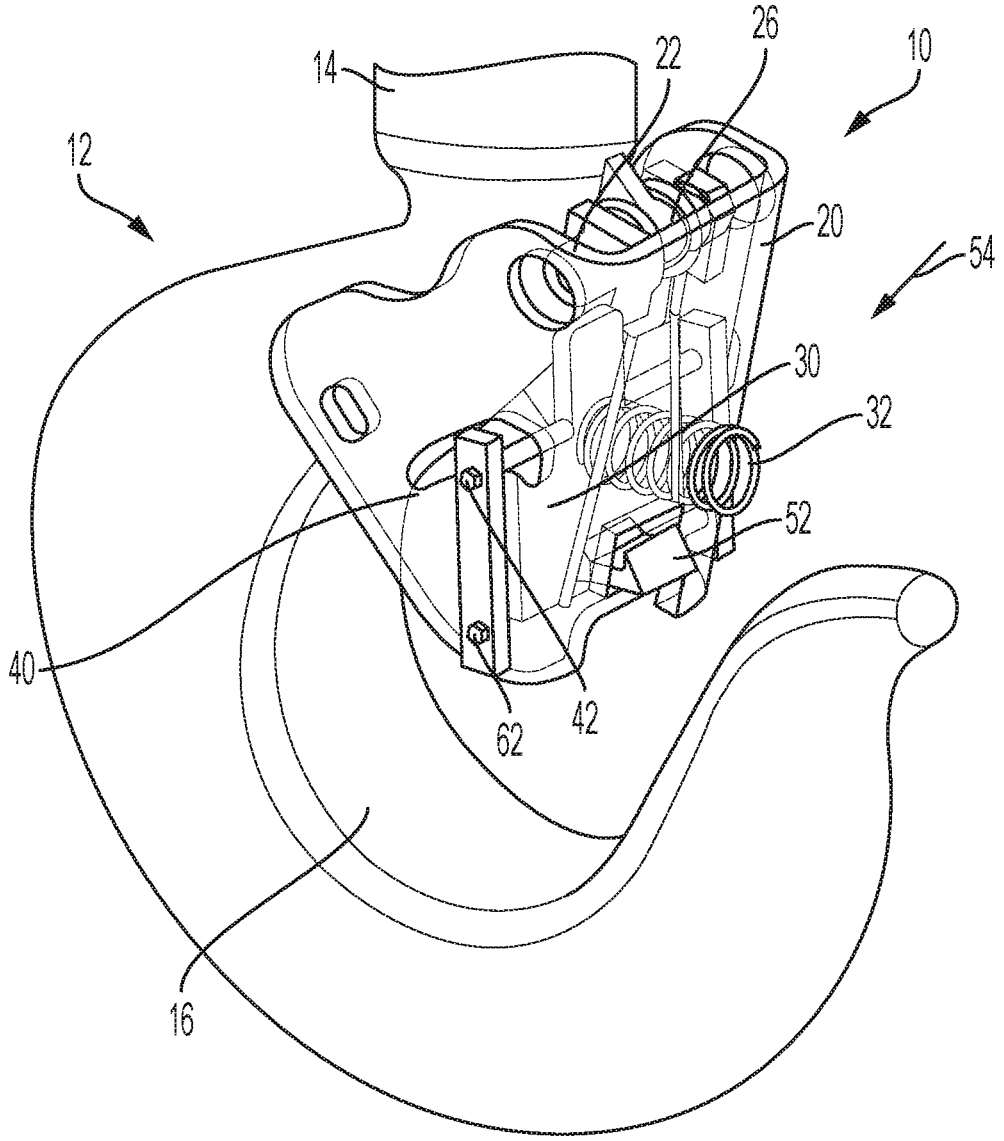
Figure 5:
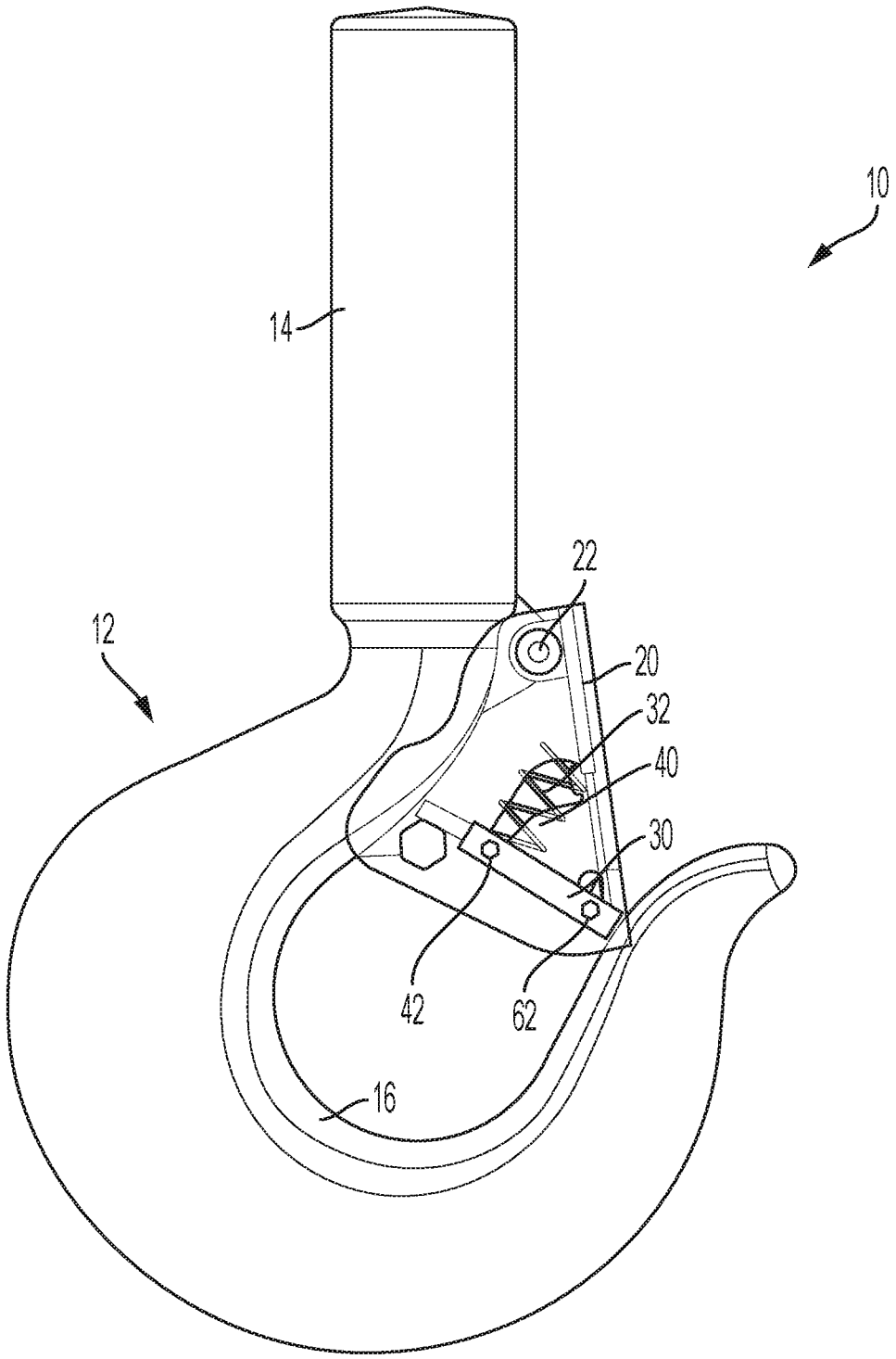
FIGS. 5 through 8 illustrate side views of the positive locking latch assembly for a hook in the same sequential, alternate positions as shown in FIGS. 1 through 4.
Figure 7:
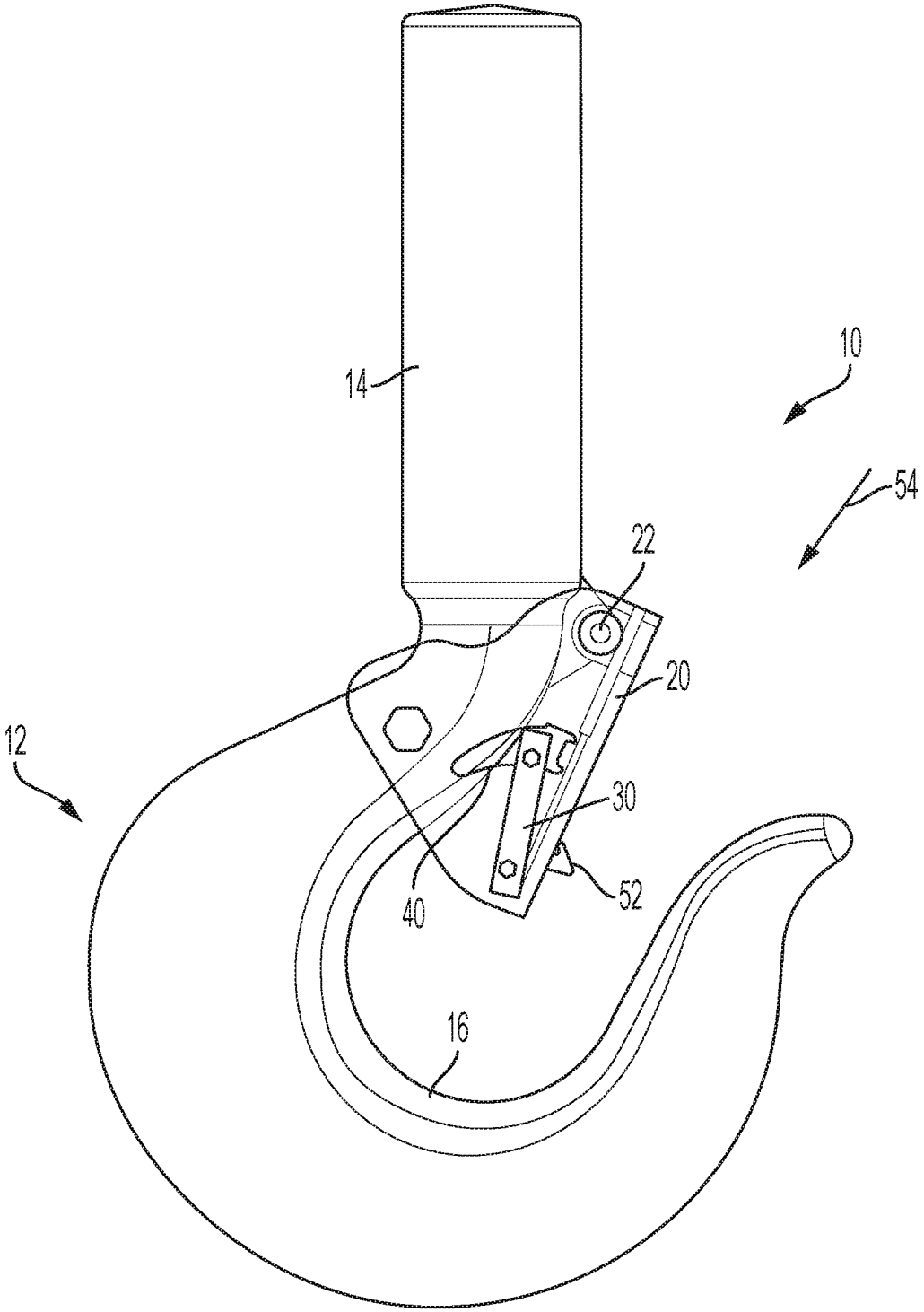

A pivot shaft 22 passes transversely through the latch body and through an opening in the shank 14 of the hook 12 in order to permit the latch body to rotate between an open position shown in FIGS. 3 and 7 and a closed position as shown in FIGS. 1 and 5.

At least one torsion spring 26 surrounds the pivot shaft 22. In one preferred embodiment, a torsion spring 26 surrounds the pivot shaft 22 and urges the latch body toward the closed position shown in FIGS. 1 and 5. Although a torsion spring is employed in the preferred embodiment, other types of spring mechanisms might be utilized.

A lock plate 30 is retained within the latch body. The lock plate 30 is movable between a locked position shown in FIGS. 1, 4, 5, and 8 and an unlocked position shown in FIGS. 2, 3, 6, and 7. A compression spring 32 within the latch body extending between the lock plate 30 and the latch face 20 urges the lock plate 30 toward the locked position.

A pair of opposed arcuate first slots 40 are provided in the opposed sides of the latch body, respectively. The first slots 40 each have an enlarged upper portion. A pair of first extending side posts 42 extend from opposed sides of the lock plate 30.

The pair of first side posts 42 are movable within the pair of first slots 40 so that the lock plate 30 moves between a locked position as shown in FIGS. 1 and 5 and an unlocked position to be described and shown in detail in FIGS. 2, 3, 6, and 7.

A tab 50 extends outward from the lock plate 30. In one preferred embodiment, the tab extends perpendicularly from the lock plate 30, although other configurations are possible. The tab 50 terminates in a lip 52 extending or protruding from the tab 50. The tab 50 and lip 52 extend into an opening in the latch face.

A pair of second slots 60 are provided on opposed sides of the latch body. The lock plate 30 has a pair of opposed second extending side posts 62 that are received in the pair of second slots 60. The second side posts 62 are movable within the second slots 60 to retain the lock plate 30 in an unlocked position as will be described and shown herein.

The latch body also includes an optional opening or openings 66 to receive and retain a transverse stop (not shown) to permanently retain the latch body in a closed position. When the transverse stop resides in the opening or openings 66, the latch assembly may not be opened. Accordingly, the transverse stop may be utilized as an optional, redundant mechanism to retain the latch assembly in the closed position.

Figure 2:
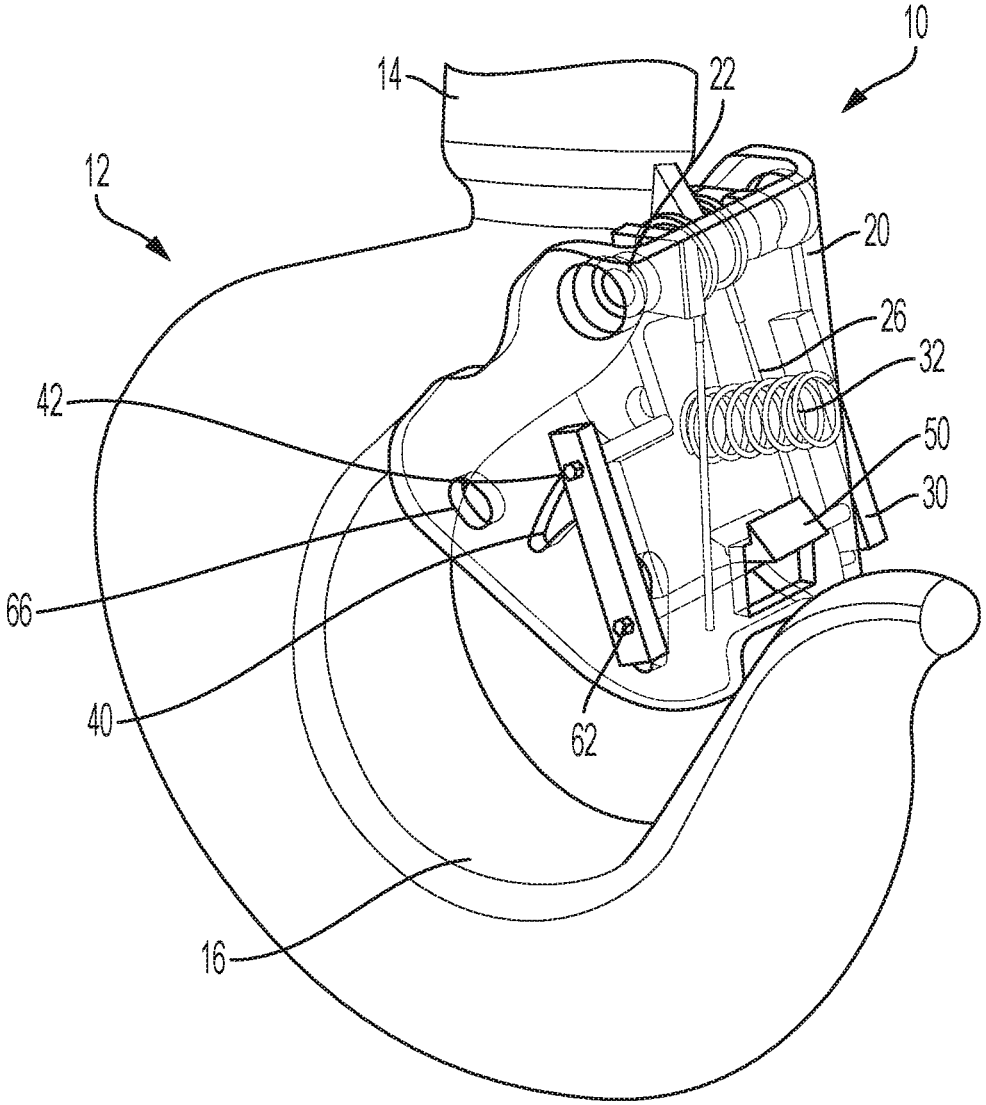
Figure 6:
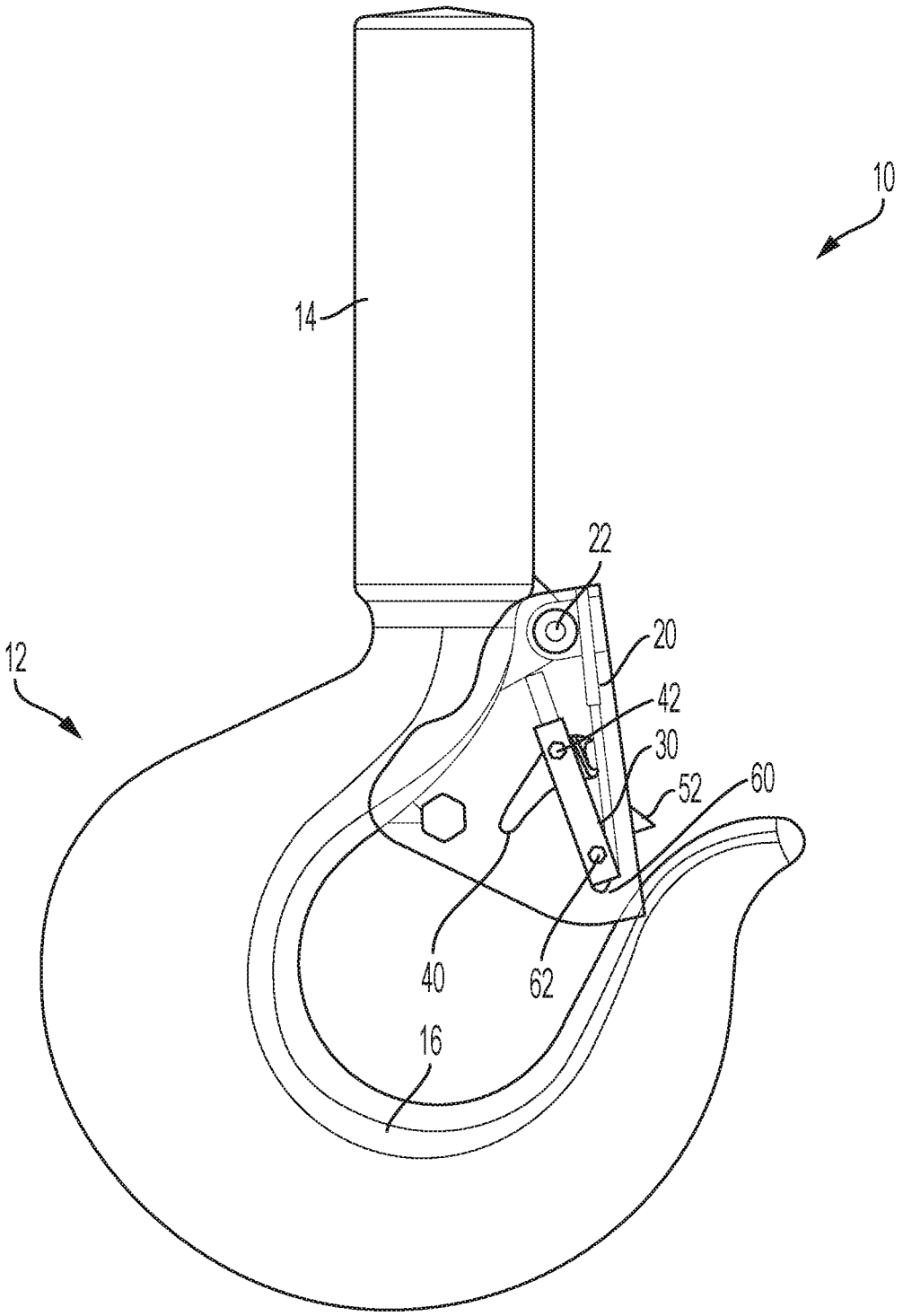

FIGS. 2 and 6 illustrate the latch assembly 10 in a closed and in an unlocked position. The latch body remains in the closed position due to the force of the torsion spring 26. The lock plate 30 has been manually moved to an unlocked position by manually moving and rotating one or both of the pair of first side posts 42 in the arcuate pair of first slots 40. The manual movement of the lock plate 30 overcomes the force of the compression spring 32. The pair of arcuate first slots 40 are wider or enlarged at their upper end. Accordingly, the lock plate 30 may be slid or manually moved upward. As the lock plate is moved upward, the second posts 62 are also moved upward in the second slots 60.

The tab 50 extends beyond the face 20 of the latch body. As the lock plate 30 is slowly released, the compression spring 32 urges the lock plate 30 and the tab 50 toward the locked position and the lip 52 will engage the latch face 20 of the latch body. Accordingly, the latch plate 30 is closed in an unlocked position.

FIGS. 3 and 7 show a further alternate sequential position. While the latch body is in the closed and unlocked position, a load or rigging for a load (not shown) is moved in the direction of arrow 54 toward and into the mouth and into the saddle 16 of the hook 12. The force of the incoming load will engage the latch face 20 and will overcome the force of the torsion spring 26 and thereby move the latch body from the closed position shown in FIG. 2 toward the open position shown in FIG. 3.

In addition, the incoming load will engage the lip 52 of the tab 50, forcing the tab 50 downward. Accordingly, the lip 52 and tab 50 will become disengaged from the outer face 20 of the latch body. Once the lip 52 has been disengaged from the latch face 20, the torsion spring 26 urges the latch body to the closed position.

Figure 4:
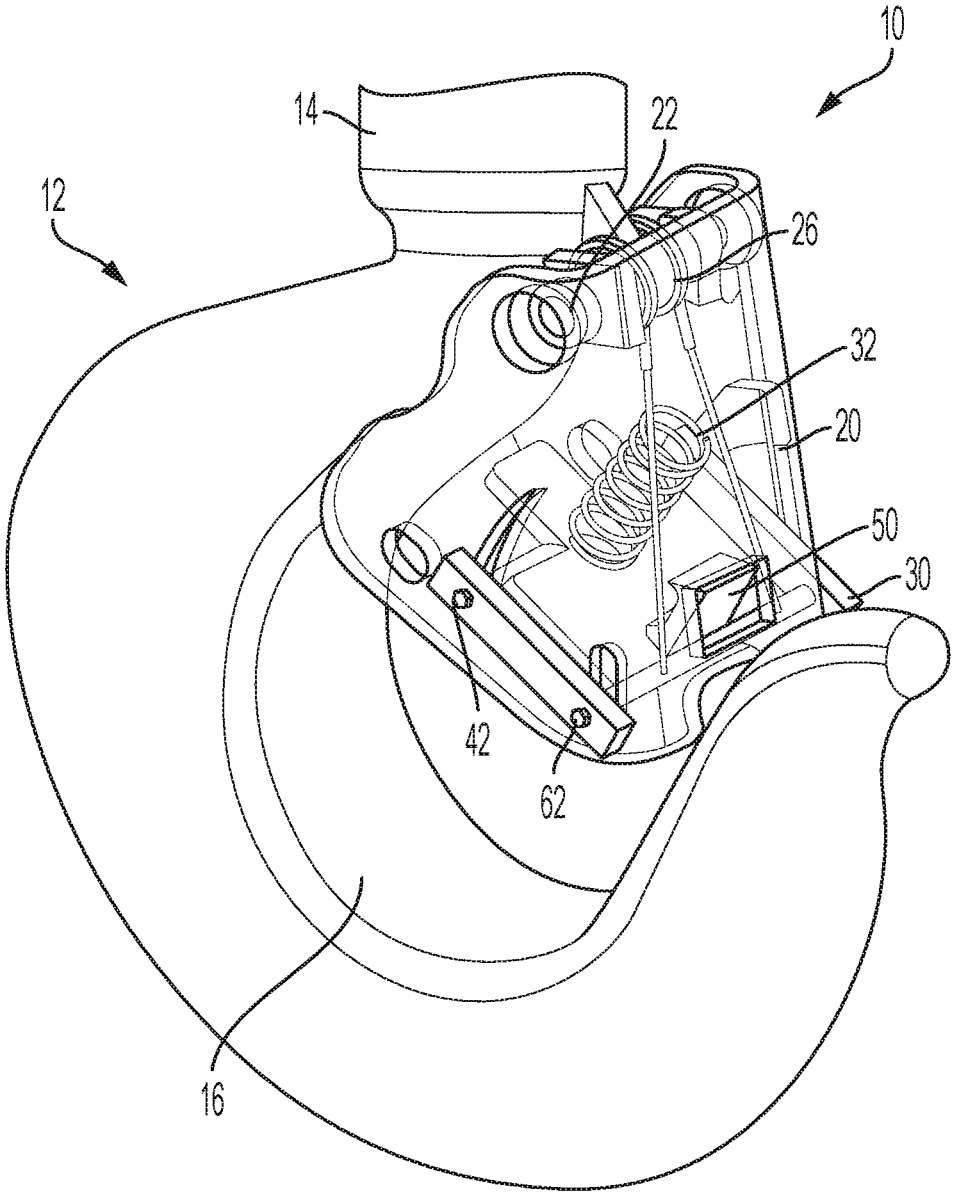
Figure 8:
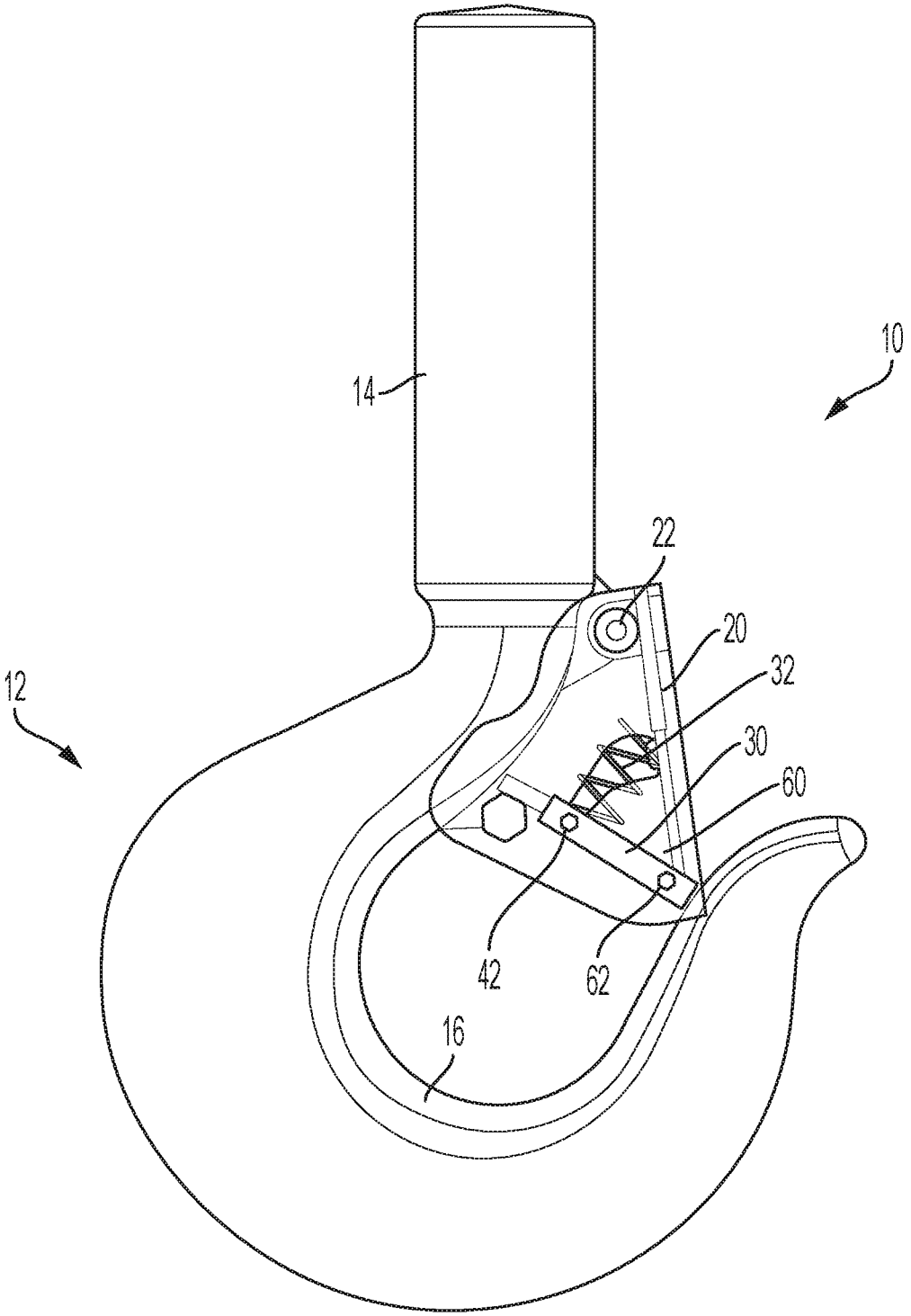

When the load (not shown) has passed the latch body and moved into the saddle of the hook 12, the force of the compression spring 26 will thereafter rotate the locking plate back to the locked position, as shown in FIGS. 4 and 8.

Accordingly, entry and receipt of a load into the saddle 16 of the hook 12 will automatically move the latch assembly 10 to a locked and a closed position.

Whereas, the invention has been described in relation to the drawings attached hereto, it should be understood that other and further modifications, apart from those shown or suggested herein, may be made within the scope of this invention.

What is claimed is:

1. A positive locking latch assembly for a hook having a saddle, which latch assembly comprises:

a latch body having a latch face, and a pivot shaft to permit said latch body to rotate between an open position and a closed position;

a torsion spring urging said latch body toward said closed position;

a lock plate retained within said latch body, said lock plate movable between a locked position and an unlocked position;

a compression spring urging said lock plate toward said locked position; and a tab extending from said lock plate into an opening in said latch face, said tab engageable with said latch face to engage said lock plate in said unlocked position; and wherein said tab extends substantially perpendicularly from said lock plate, said tab has a lip extending substantially perpendicularly therefrom, and said lip of said tab has an angled face.

2. A positive locking latch assembly as set forth in claim 1 including at least one arcuate first slot in said latch body and wherein said lock plate has at least one first extending side post movable within said arcuate first slot, said at least one first extending side post movable within said arcuate first slot between a locked position and unlocked position.

3. A positive locking latch assembly as set forth in claim 2 wherein said at least one arcuate slot comprises a pair of opposed first arcuate slots in said latch body and said at least one first extending side post comprises a pair of extending side posts receivable therein.

4. A positive locking latch assembly as set forth in claim 2 including at least one second slot in said latch body and wherein said lock plate has at least one second extending side post received in said second slot, said second extending side post movable within said second slot to retain said lock plate in an unlocked position.

5. A positive locking latch assembly as set forth in claim 4 wherein said at least one second slot comprises a pair of opposed second slots and wherein said at least one second extending side post comprises a pair of opposed second extending side posts receivable therein.

6. A positive locking latch assembly as set forth in claim 1 wherein said latch body includes an opening therethrough to receive an elongated transverse stop to permanently retain said latch body in a closed position.

7. A positive locking latch assembly as set forth in claim 1 wherein said pivot shaft passes through said latch body and through an opening in a shank of a hook.

8. A positive locking latch assembly for a hook having a shank and a saddle, which latch assembly comprises:

a latch body having a latch face and a pair of opposed sides;

a pivot shaft passing through said latch body and through an opening in a shank of a hook to permit said latch body to rotate between an open position and a closed position;

a torsion spring urging said latch body toward said closed position;

a lock plate retained within said latch body, said lock plate movable between a locked position and an unlocked position;

a pair of opposed arcuate first slots in said latch body wherein said latch plate has a pair of extending side posts movable within said pair of opposed arcuate first slots between said locked position and said unlocked position;

a compression spring urging said lock plate toward said locked position; and a tab extending from said lock plate into an opening in said latch face, said tab engageable with said latch face to engage said lock plate in said unlocked position, wherein said tab has a lip extending substantially perpendicularly therefrom; and a pair of opposed second slots in said pair of opposed sides of said latch body and wherein said lock plate has a pair of opposed second extending side posts receivable therein.

* * * * *